United States Patent [19]

Oxel

[11] Patent Number: 4,498,214

[45] Date of Patent: Feb. 12, 1985

[54] CARPET CLEANING APPARATUS WITH AUXILIARY CLEANING DEVICE ARRANGEMENT

[75] Inventor: Berton R. Oxel, Louisville, Ohio

[73] Assignee: The Hoover Company, North Canton, Ohio

[21] Appl. No.: 600,423

[22] Filed: Apr. 16, 1984

Related U.S. Application Data

[63] Continuation of Ser. No. 470,226, Feb. 28, 1983, abandoned.

[51] Int. Cl.[3] ..... A47L 7/00

[52] U.S. Cl. ..... 15/320; 15/328; 15/339; 15/359; 15/361; 15/365; 15/410

[58] Field of Search ..... 15/320, 328, 339, 361, 15/410, 365, 359, 371, 372

[56] References Cited

U.S. PATENT DOCUMENTS

| | | | |
|---|---|---|---|
| 295,506 | 3/1884 | Rockwell | 15/44 |
| 967,301 | 8/1910 | Andrews | 15/50 R |
| 1,176,990 | 3/1916 | Scherff | 15/320 |
| 1,221,324 | 4/1917 | Hodschar | 15/44 |
| 1,542,262 | 6/1925 | Morton . | |
| 1,625,147 | 4/1927 | Onofrio | 15/320 X |
| 2,045,270 | 6/1936 | Hoover | 15/360 X |
| 2,100,806 | 11/1937 | Kern | 15/352 X |
| 2,553,748 | 5/1951 | Carlson et al. | 15/182 |
| 2,622,254 | 12/1952 | Medelson | 15/320 X |
| 2,635,276 | 4/1953 | Norris | 15/320 |
| 2,635,278 | 4/1953 | Belknap | 15/353 |
| 2,677,845 | 5/1954 | Daiger | 15/333 |
| 2,842,792 | 7/1958 | Coons | 15/355 |
| 2,842,793 | 7/1958 | Hurd | 15/359 |
| 2,850,757 | 9/1958 | Duff | 15/359 |
| 2,938,225 | 5/1960 | Carabet | 15/356 |
| 2,972,764 | 2/1961 | Linenfelser | 15/50 C X |
| 2,986,764 | 6/1961 | Krammes | 15/320 |
| 3,101,505 | 8/1963 | Belicka et al. | 15/359 X |
| 3,120,016 | 2/1964 | Knapp et al. | 15/98 |
| 3,159,726 | 12/1964 | Helm | 200/52 R |
| 3,200,433 | 8/1965 | Downey | 15/328 |
| 3,579,699 | 5/1971 | Balzer | 15/361 |
| 3,624,861 | 12/1971 | Freiheit | 15/361 X |
| 3,843,989 | 10/1974 | De Maagd | 15/320 X |
| 4,096,601 | 6/1978 | Knestele | 15/320 |
| 4,217,674 | 8/1980 | Hayashi et al. | 15/361 |
| 4,335,486 | 6/1982 | Kochte | 15/321 |
| 4,369,544 | 1/1983 | Parisi | 15/320 |

FOREIGN PATENT DOCUMENTS 1462011 1/1977 United Kingdom .

*Primary Examiner*—Chris K. Moore

*Attorney, Agent, or Firm*—Gerald H. Kreske; A. Burgess Lowe

[57] ABSTRACT

A carpet cleaning apparatus is disclosed which includes a new and improved auxiliary cleaning device arrangement incorporated in a conventional vacuum cleaner. The auxiliary cleaning device is movable into a carpet engaging position for frictionally engaging a carpet surface and simultaneously distributing cleaning material thereon which emulsify, rub, and thereby cause release of dirt, dust and other foreign particles from carpet fibers and allow their removal and collection by agitator and suction cleaning elements of the apparatus. A retraction means is provided for automatically retracting the auxiliary cleaning device in response to handle assembly movement to a storage position, and a retaining means is provided to lock the device in the retracted position. The retaining means selectively either permits movement of the device to a carpet engaging position or maintains the device in a retracted position independently of subsequent handle assembly movement. In one arrangement utilizing a liquid fed auxiliary cleaning device, a liquid shut-off means is disclosed for automatically terminating liquid flow to the device in response to movement of the handle assembly to a substantially vertical or storage position.

24 Claims, 11 Drawing Figures

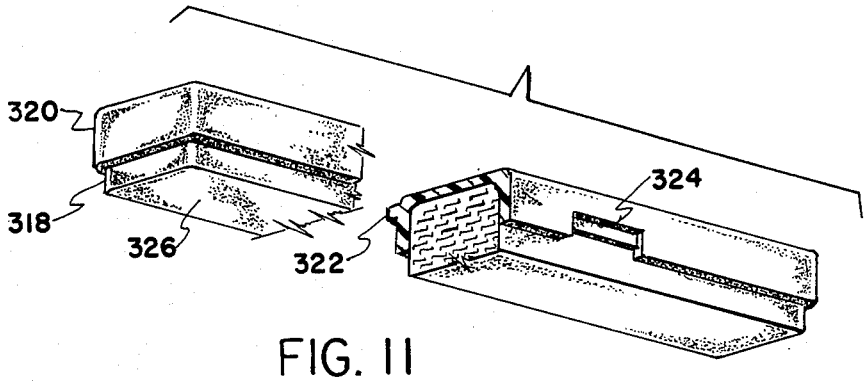
FIG. 11
FIG. 3
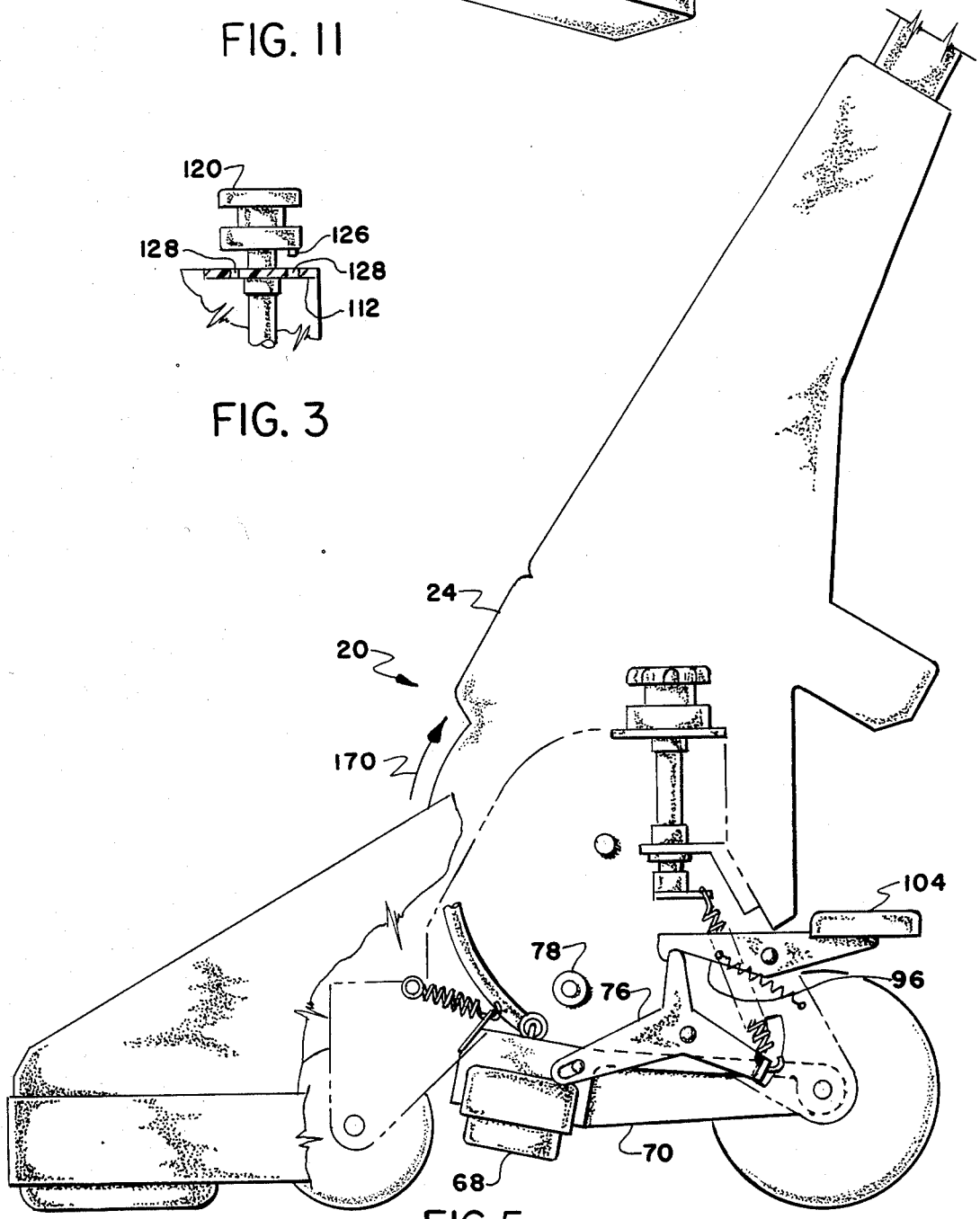
FIG.5

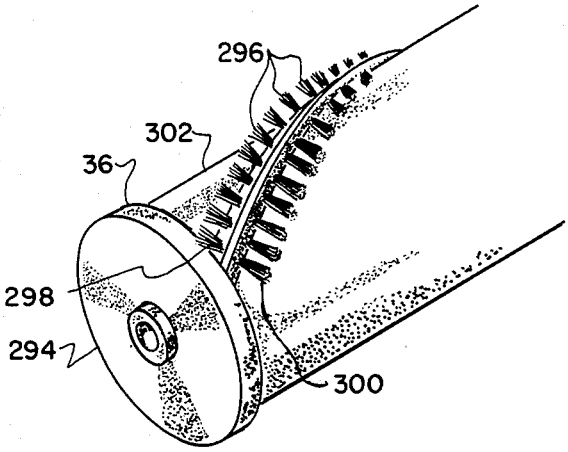
FIG. 9
FIG. 10
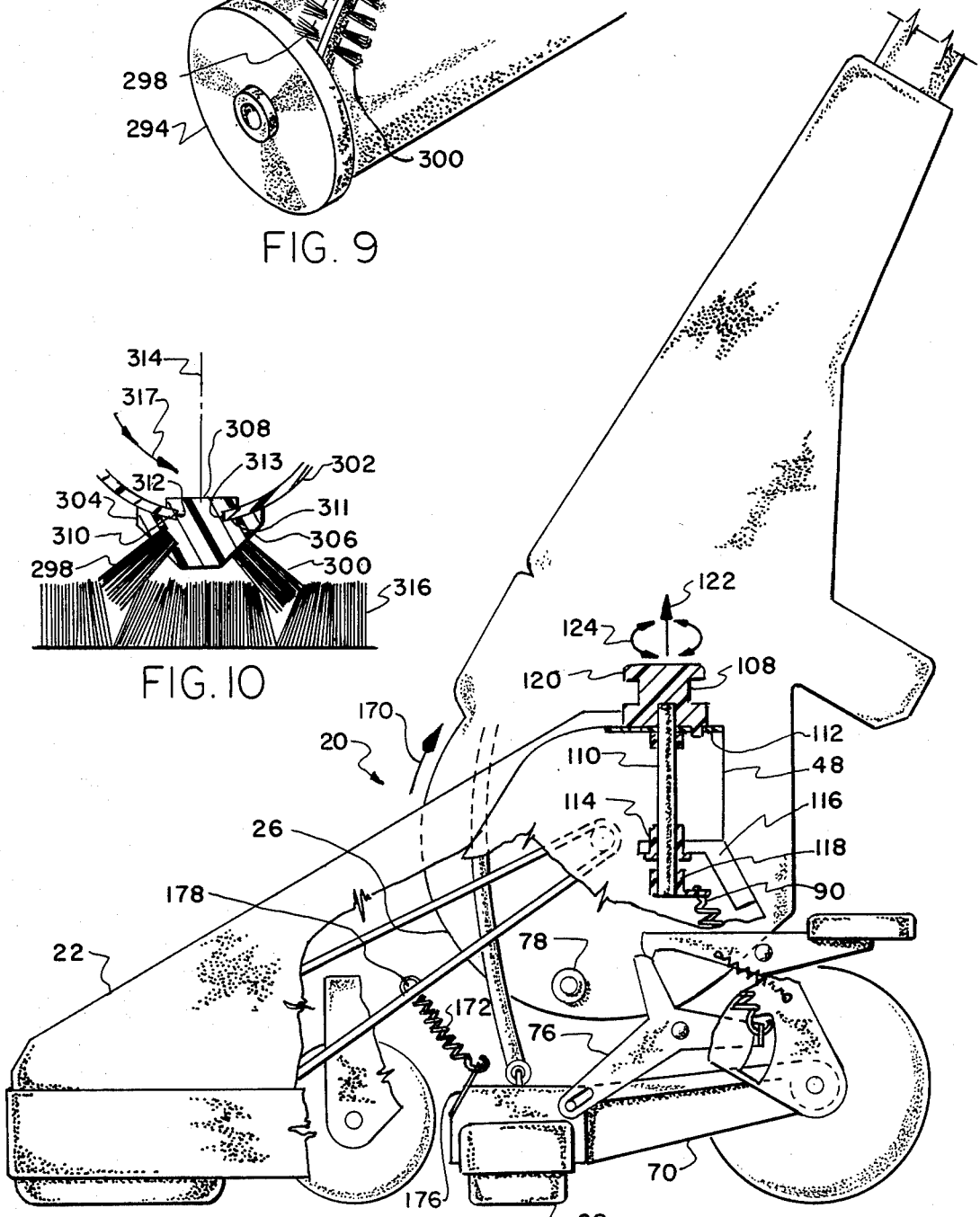
FIG. 6

CARPET CLEANING APPARATUS WITH AUXILIARY CLEANING DEVICE ARRANGEMENT

CROSS REFERENCE TO RELATED APPLICATION

This application is a continuation of my co-pending application Ser. No. 470,226, filed Feb. 28, 1983, and now abandoned.

BACKGROUND OF THE INVENTION

The present invention relates generally to carpet cleaning apparatus and more particularly, to improvements in carpet cleaning apparatus which combine conventional agitation and suction cleaning with an additional cleaning means.

It is known that conventional vacuum cleaners do not remove all dirt and dust particles from a carpet. Although agitation combined with suction increases dirt removal, there are dirt and dust particles that adhere to carpet fibers and remain following conventional vacuum cleaning. Thus, remaining particles contribute to a deterioration in carpet appearance over an extended period of time. Of course, apparatus are known such as, for example, carpet shampooers and hot water extractors, which may be utilized to remove these remaining foreign particles. However, frequent use of such apparatus can be time consuming and also expensive if the cleaning is performed by professional carpet cleaners. As a result, such additional carpet cleaning may not be performed as frequently as is preferred and thus, carpet appearance tends to deteriorate appreciably between such thorough cleanings.

It is also known that carpet appearance can be improved by applying only a small amount of liquid or wet cleaning material or by applying a dry cleaning compound or particles to the carpet. Such materials tend to release foreign particles adhering to carpet fibers so that they can be removed by conventional vacuuming. These carpet cleaning techniques are often desirable since the carpet is not wetted at all or only wetted to an insignificant degree so as to avoid long drying times often associated with the more extensive carpet cleaning methods such as shampooing and water extraction. Although they are not intended to replace the more extensive carpet cleaning methods, such techniques do improve carpet surface appearance between more thorough cleanings and may reduce the needed frequency of such thorough cleanings.

Therefore, it would be desirable to develop an improved carpet cleaning apparatus having an auxiliary cleaning device for improving carpet surface appearance. An apparatus which would provide an improved means of mounting and controlling such an auxiliary cleaning device. Such an apparatus which would also provide an improved operating interrelationship with a conventional vacuum cleaner so as to make its use convenient and effective would be highly desirable and is in fact provided by the present invention.

SUMMARY OF THE INVENTION

Accordingly, a general object of the present invention is to provide a new and improved carpet cleaning apparatus having an auxiliary cleaning device.

A more specific object of the present invention is to provide a new and improved carpet cleaning apparatus having a new and improved arrangement for mounting and controlling an auxiliary cleaning device.

Another object of the present invention is to provide a new and improved carpet cleaning apparatus having an auxiliary cleaning device and features which interrelate auxiliary device operation and conventional vacuum cleaning operation so as to provide effective, convenient and selective operation of the auxiliary device.

These and other objects will be readily apparent from the following description taken in connection with the accompanying drawings.

In carrying out the invention in one form thereof, a carpet cleaning apparatus is provided which includes a new and improved auxiliary cleaning device arrangement incorporated in a conventional vacuum cleaner without affecting normal operation of the vacuum cleaner. A retraction means is provided which is responsive to pivotal movement of a handle assembly of the apparatus to a storage position where it is substantially vertical relative to a carpeted floor. The retraction means automatically moves the auxiliary cleaning device to a retracted position out of engagement with a carpet surface when the handle assembly is moved to the storage position. Further, a retaining means is also provided for locking the cleaning device in the retracted position. The retaining means selectively either permits movement of the auxiliary cleaning device to a carpet engaging position or maintains the auxiliary cleaning device in the retracted position independently of subsequent handle assembly movement from the storage position.

In one form, an auxiliary cleaning device comprises a bar of dry material. In a carpet engaging position, the bar frictionally engages a carpet and at the same time, disperses dry particles on the carpet surface so as to capture, rub and thereby cause release of dirt, dust and other foreign particles from carpet fibers and allow their removal from the carpet by agitator and suction cleaning elements of the carpet cleaning apparatus.

In another form, the carpet cleaning apparatus includes an auxiliary cleaning device comprising a porous bar of fiber material. The apparatus is provided with a liquid supply means to supply the fiber bar with liquid cleaning material. The bar frictionally engages a carpet and transfers a small amount of the liquid cleaning material to the carpet which causes release of dust and/or dirt particles adhering to the carpet fibers and allow their removal via agitator and suction cleaning elements of the apparatus. The apparatus may also be provided with a liquid shut-off means responsive to movement of a handle assembly of the apparatus to a storage position for terminating liquid flow to the porous bar.

BRIEF DESCRIPTION OF THE DRAWINGS

FIG. 3 is a side elevation detail of a bias adjustment knob shown in FIG. 2 and illustrating operational details.

FIGS. 5 and 6 are side elevational views, with parts thereof broken away, showing mounting and operating details of an auxiliary cleaning device illustrated in FIGS. 1 and 2.

FIG. 9 is a partial perspective view of an agitator for the carpet cleaning apparatus of FIGS. 1–7.

FIG. 10 is a partial cross sectional view of the agitator of FIG. 9.

FIG. 11 is a perspective view, with parts thereof cross-sectioned and displaced, of an auxiliary cleaning device comprising dry material.

DESCRIPTION OF THE PREFERRED EMBODIMENTS

Figure 1:
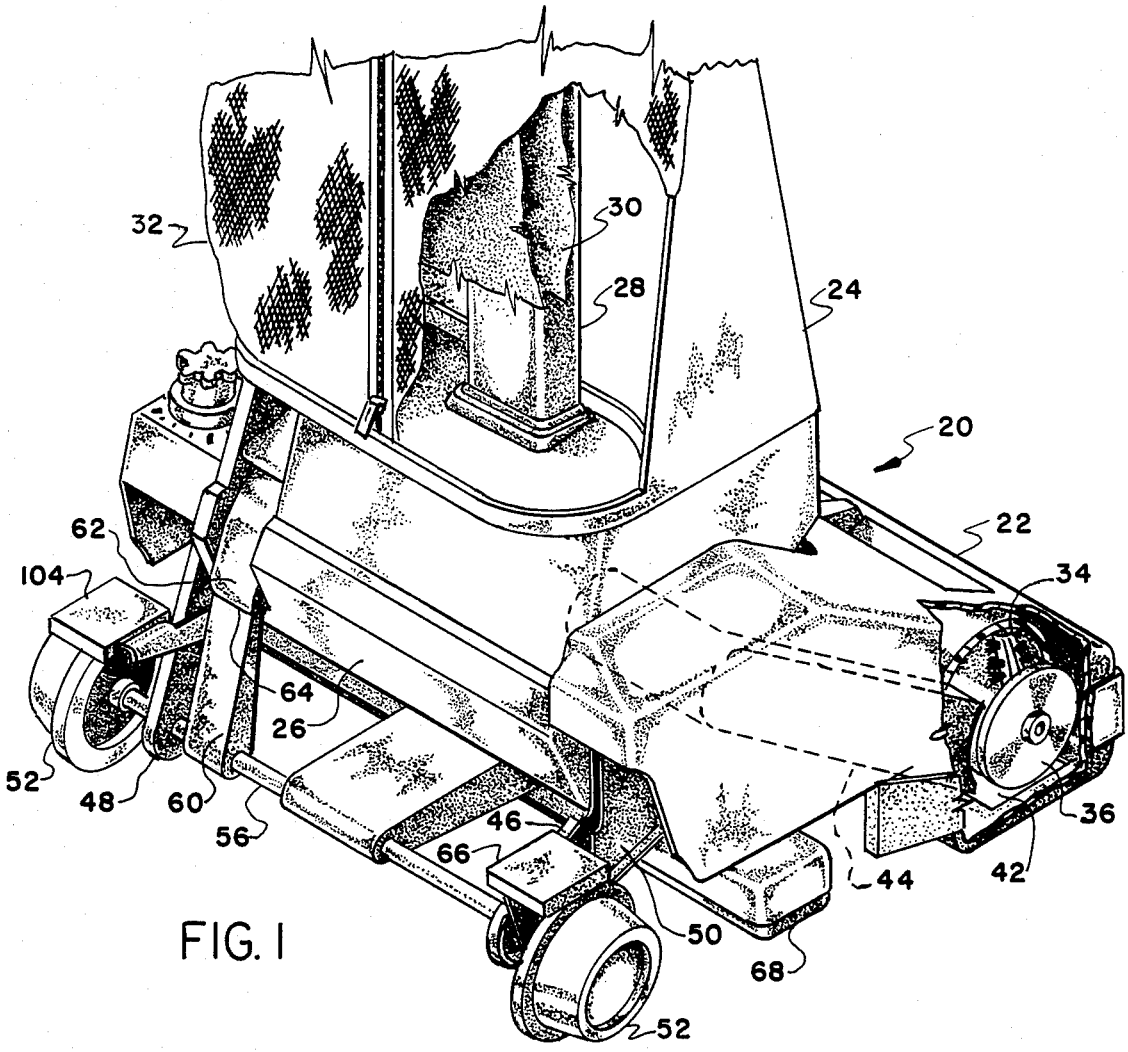
FIG. 1 is a rear perspective view, with parts thereof broken away, of a carpet cleaning apparatus embodying the invention in one form thereof.

FIG. 1 illustrates a carpet cleaning apparatus 20 of one type which embodies features of the present invention in one form. The apparatus includes a nozzle 22 pivotally connected to a handle assembly 24. The handle assembly includes a vacuum generating means including a not shown conventional motor/fan unit as is used on Hoover cleaner model U3101 located within motor/fan housing 26 and further includes a dirt transporting duct 28 extending from the motor/fan unit and emptying into inner dirt collecting filter bag 30 encompassed by an air pervious jacket 32. The nozzle includes a nozzle chamber 34 extending in a transverse direction therewithin. The nozzle chamber has a rotatable agitator 36 mounted therein driven by motor/fan shaft 38 (FIG. 2) via belt 40 (FIG. 2), and a transversely extending opening 42 for providing air suction and agitator communication with a carpet surface. A dirt transporting duct 44 extends between the nozzle chamber and the motor/fan unit for transporting dirt and debris drawn via suction from the nozzle opening to the motor/fan unit where it is then discharged therefrom via the handle mounted duct into the dirt collecting filter bag.

The carpet cleaning apparatus 20 is provided with several known or conventional features that are provided on Hoover model U3101 upright cleaner. For example, the handle assembly 24 is supported in a conventional manner by two side frames 46 and 48 which support the motor/fan housing 26 therebetween and permit its pivotal movement relative to the frames from the illustrated storage position where the handle assembly is substantially vertical relative to a floor surface to an operating position (see FIG. 5) where it is inclined relative to a floor surface. The nozzle 22 is also supported by the two side frames in a conventional manner by its interconnection therewith via two oppositely disposed nozzle plates such as, for example, the illustrated nozzle plate 50 which interconnects with the side frame 46. Apparatus support and transport capability is provided by two rear wheels 52 and two adjacently disposed trundle wheels (wheel 54 shown in FIG. 2) which are interconnected with the two side frames via rear axle 56 and front axle 58 (FIG. 2), respectively.

In addition, a conventional handle lock means is provided which includes a cam lever 60 secured to the axle 56 and a cam surface 62 formed on the motor fan housing 26 of the handle assembly 24. The handle assembly is retained in its vertical or storage position by engagement of the cam lever with abutment 64 of the cam surface. A conventional handle release means is also provided which is illustrated as spring return release pedal 66 which is secured to the axle. Actuation, by depression of the pedal, causes the axle to pivot so as to move the cam lever outwardly relative to the handle assembly and out of engagement with the cam surface abutment and thereby permitting the handle assembly to be pivotally moved relative to the nozzle to an operating position (see FIG. 5) where it is inclined or at an acute angle relative to a floor surface. Although a positive handle locking means has been illustrated and described, other locking means could be provided to maintain the handle assembly in the storage position such as, for example, a spring or cam arrangement which would eliminate the need for a release pedal in order to permit handle assembly movement from the storage position to the operating position.

An auxiliary cleaning device, illustrated as a cleaning bar 68, is provided to enhance the above described traditional vacuum cleaning operation. The bar is disposed transversely within the apparatus and spaced longitudinally between the agitator 36 and the rear wheels 52. The bar is selectively movable relative to the nozzle 22 and agitator 36 so as to move it into the illustrated carpet-engaging or down position. In this position, the bar frictionally engages a carpet surface and at the same time deposits a cleaning material thereon so as to cause release of adhered dust, dirt and other particles from fibers of a carpet so that they can be removed from the carpet via suction and agitation. The cleaning material emulsify and capture the adhering particles so that they can be more easily removed from the carpet fibers. The frictional engagement of the bar provides both distribution of cleaning material on the carpet fibers and agitation of the fibers which promotes release of adhering particles.

Figures 2, 4:
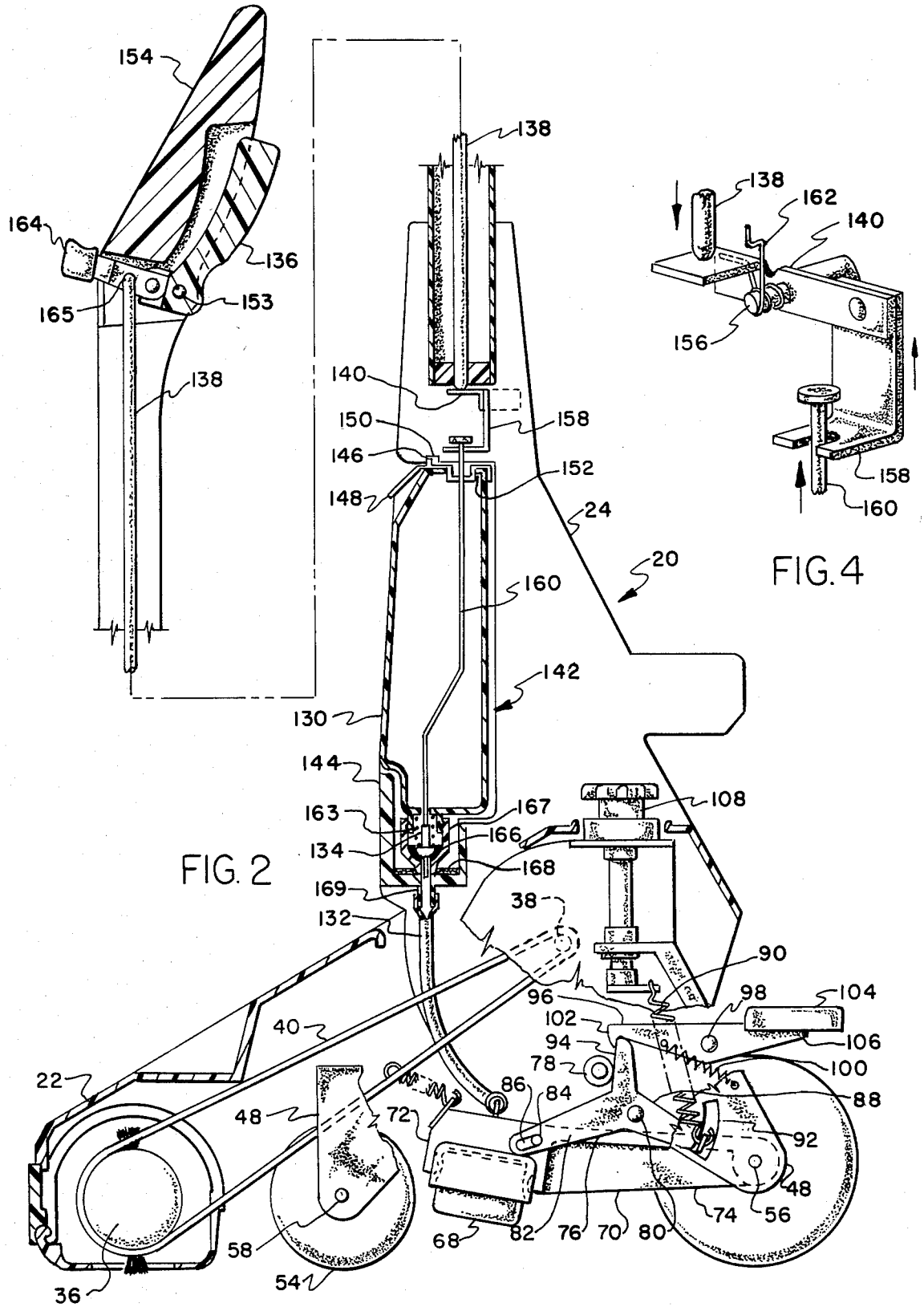
FIG. 2 is a side elevational view, with parts thereof broken away, of the carpet cleaning apparatus illustrated in FIG. 1.
FIG. 4 is a perspective detail view of a portion of an actuator arrangement for operating a dispensing valve illustrated in FIG. 2.

FIGS. 2–7 illustrate details of the carpet cleaning apparatus 20 including mounting and operational details of the cleaning bar 68. Referring to FIG. 2, the handle assembly 24 is illustrated in its substantially vertical or storage position with the cleaning bar in a retracted position whereby it is out of a carpet engaging position. A guide means, illustrated as an auxiliary mounting support 70, is provided for guiding the cleaning bar into and out of engagement with a carpet surface and also provides support for the bar in the illustrated arrangement. The auxiliary mounting support 70 includes a first support portion or bar support 72 having the cleaning bar mounted therewithin and a second support portion or link arm 74 attached to the first portion and also mounted about the rear axle 56 for support and pivotal movement about the axle. A retraction means carried in part by the handle assembly and in part by the auxiliary mounting support, is provided for moving the cleaning bar upwardly relative to the nozzle 22 and agitator 36 to the illustrated up or retracted position. The retraction means comprises linkage 76 and protrusion 78 which projects outwardly from the motor/fan housing 26 (see FIG. 6) of the handle assembly. The linkage is pivotally attached to the side frame 48 by connecting pin 80 and has a first leg 82 thereof supported by pin 84 attached to the first support portion of the auxiliary mounting support with the pin extending through slot 86 of the linkage so as to permit sliding movement therebetween. A second leg 88 of the linkage is attached to a bias spring 90 through slot 92 in the side frame. As the handle assembly is rotated to the illustrated vertical position, the protrusion on the motor/fan housing moves therewith to engage and move the linkage via its engagement seal 166 are integrally attached to the liquid container via a screw cap 167 which seats against a seal 168. Thus, liquid flow is directed in a controlled manner by the dispensing valve from the container, through a port 169 formed in the handle assembly and to the flexible hose attached to the port. The above-described dispensing valve and its actuator arrangement are similar to an arrangement utilized on Hoover model F3119 shampooer except for the initial saturation means or lever and except for the valve rod being indirectly lifted using the illustrated pivoted beam.

FIGS. 2, 5 and 6 illustrate operational movement of the cleaning bar 68. In FIG. 2, the handle assembly 24 is in the storage position where it is generally vertical relative to a floor surface with the cleaning bar being restrained in its retracted position by the protrusion or projection 78 engaging the linkage 76 and is locked in this retracted position by the lock lever 96 with its lip 102 engaging the linkage.

When carpet cleaning is desired, the handle assembly release pedal 66 (FIG. 1) is actuated to permit pivoting of the handle assembly 24 as illustrated by arrow 170 to an operating position where it is inclined relative to a floor surface as illustrated in FIG. 5. As can be seen in FIG. 5, even though the projection 78 moves away from engagement with the linkage 76, the linkage and thus, the cleaning bar 68 is retained in its retracted position by the engagement of the lock lever 96 with the linkage. When additional or supplemental cleaning is also desired, the bar release pedal 104 is actuated by depression thereof which causes the locking lever to pivot out of engagement with the linkage thereby allowing the auxiliary mounting support 70 to pivot downwardly due to its own weight and action of the bias spring 90 (FIG. 2) which causes a downwardly directed force to be exerted on the support via the pivoting linkage.

As illustrated in FIG. 6, the release of the linkage 76 causes the auxiliary mounting support 70 to move the cleaning bar 68 downwardly to a carpet engaging position. Cleaning liquid can then be dispensed to the cleaning bar from the liquid container 130 (FIG. 2) in a manner as previously described in reference to FIGS. 2 and 4 and the bar, in turn, transfers the material to a carpet surface via frictional engagement therewith. Thus, the carpet cleaning apparatus 20 provides a combined cleaning operation upon a carpet, i.e., a conventional agitation and vacuuming operation and a supplemental or an auxiliary cleaning operation via the cleaning bar so as to release dirt, dust and other foreign particles adhering to the carpet.

As can also be seen in FIG. 6, a counter bias means, illustrated as spring 172 and spring 174 (FIG. 7), is also provided for controlling frictional engagement of the cleaning bar 68 with a carpet. The springs are attached to the auxiliary mounting support 70 by way of respective plates, such as plate 176, and are attached to the nozzle 22 at point 178 so as to form a triangular configuration. Although not essential, the springs do provide an additional means of controlling the frictional engagement force between the cleaning bar and a carpet surface.

Figure 7:
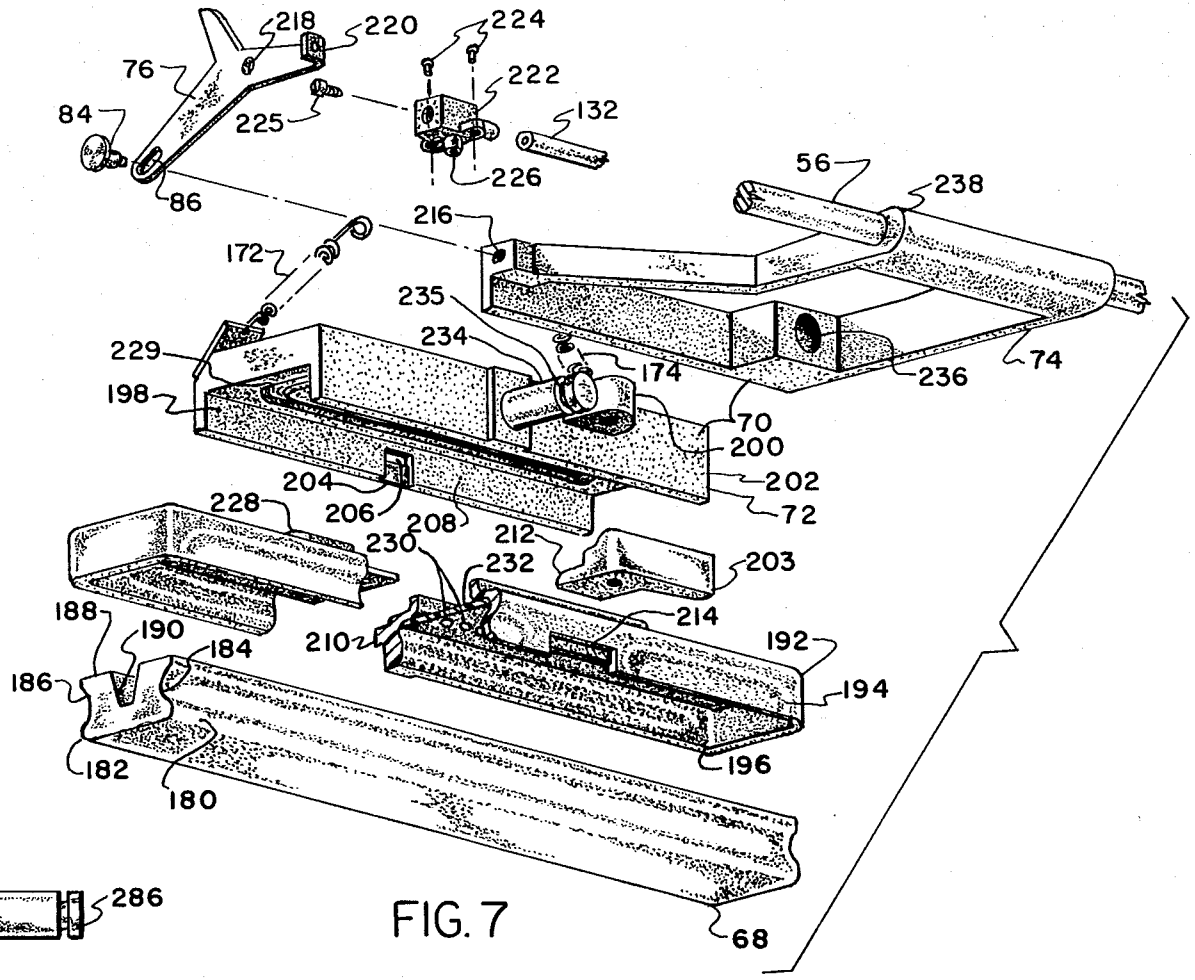
FIG. 7 is an exploded perspective view of the auxiliary cleaning device arrangement of FIGS. 2, 5 and 6 showing mounting and support details.

FIG. 7 is an exploded perspective view showing the cleaning bar 68 and its mounting arrangement. As can be seen, the cleaning bar is generally rectangular in shape with two sides 180 and 182 being provided with recesses 184 and 186, respectively, and with a top portion 188 being provided with a generally U-shaped recess 190. Although it is not essential, the U-shaped recess does save bar material, facilitates bar mounting and promotes initial saturation by providing an unobstructed path for liquid to flow across the length of the bar thereby hastening saturation across the entire bar length. As mentioned previously, the illustrated cleaning bar was formed by extruding and compressing synthetic fiber material, and thus, it is flexible or resilient. The bar is assembled or mounted in bar holder 192 by compressing the two sides and moving it into the holder. The bar is retained therewithin by inherent spring forces, due to the bar resiliency, exerted by the two sides or legs of the bar against holder sides 194 and 196, respectively. The bar and bar holder are received within recess or channel 198 of the first support portion 72 of the auxiliary mounting support 70. The first support portion is also provided with a boss 200 on side 202 thereof to which a pivoting latch 203 is screw mounted and is also provided with recess 204 having an aperture 206 therewithin on side 208. The bar holder is provided with an integral projection 210 which extends through the aperture to retain and position the holder within the first support portion. Retention is further accomplished by rotation of the pivoting latch so that tip 212 thereof engages recess ledge 214 of the bar holder. In one fabricated arrangement, the bar holder was formed of plastic and the auxiliary mounting support was formed of aluminum, but other suitable materials may be utilized. As is also illustrated, the linkage 76 is connected to the first support portion via the pin 84 which extends through the linkage slot 86 and is secured within drill 216 of the first support portion thereby permitting sliding movement of the linkage.

For transferring cleaning liquid to the cleaning bar 68, a flow control valve 222 is provided to which the flexible hose 132 is attached with the valves being secured to the first support portion 72 via screws 224. Although the flow control valve is not essential since a flow control means is already provided by the dispensing trigger 136 (see FIG. 2), it does provide an additional means to control the flow of liquid to the bar. The maximum flow through the valve is adjusted by rotating valve throttle 225. When assembled, cleaning liquid flows from the flexible hose through the flow control valve and out port 226 thereof into generally rectangularly shaped holder reservoir 228 within the bar holder 192. A packing seal 229 located on the first support portion interfits with the bar holder to provide a liquid seal about the reservoir and prevent leakage or spillage from the upper portion of the reservoir. Base 232 of the holder reservoir has a plurality of holes such as, for example, holes 230, which are spaced apart in such a manner as to provide substantially even distribution of the liquid from the reservoir to the bar.

A carpet contact compensating means is provided to automatically establish a more uniform contact interrelationship between the cleaning bar 68 and a carpet surface. Such means is provided by pivotally interconnecting the first support portion or bar support 72 and the second support portion or link arm 74 of the auxiliary support 70 via pivot post 234 which extends perpendicular from the side 202 of the first support portion at a generally central location along the length or transverse extent of the bar as illustrated in FIG. 7. The pivot post is received within circular opening 236 of the second support portion and held therein by a not shown conventional retainer ring which fits within circular groove 235 of the pivot post. With this interfitting relawith third leg 94 of the linkage for retracting the cleaning bar upwardly out of engagement with a carpeted surface.

Once in its retracted position, the cleaning bar 68 is locked in the retracted position by a retaining means comprising lock lever 96 in the illustrated arrangement which selectively permits movement of the bar to a carpet engaging position or maintains the device in the retracted position independently of subsequent movement of the handle assembly 24. The lock lever is pivotally attached to the side frame 48 via pin 98; is biased downwardly by spring 100 attached between the lever and the side frame; and is provided with a lip 102 thereon to engage and lock the linkage and cleaning bar in the upward or retracted position. An auxiliary release means, shown as pedal 104 (also shown in FIG. 1) and integral lever extension 106, is also provided to disengage the lock lever and the linkage. Depression of the pedal causes the locking lever to pivot upwardly to disengage the lip from the linkage so as to permit downward movement of the cleaning bar as the protrusion 78 is moved away from the linkage during downward movement of the handle assembly to the operating or inclined position.

A biasing means is provided to control frictional engagement between the cleaning bar 68 and a carpet which permits adjustment for different carpet types; adjustment of the depth of bar penetration and cleaning material dispersement within a particular carpet; and adjustment to vary the manipulative or pushing effort of the carpet cleaning apparatus 20. The biasing means comprises the bias spring 90 and spring tension adjusting device 108. Referring to FIG. 6 where the adjusting device is illustrated in cross section, the adjusting device 108 includes rod 110 which is mounted for vertical and rotational movement within apertured support member 112 attached to the side frame 48 and within bearing sleeve 114 secured within support member 116 which is also attached to the side frame. The spring 90 is attached at one end thereof to spring support 118 which is secured to the lower end of the rod and is attached at its opposite end to the linkage 76 so as to cause a downwardly directed force to be exerted on the bar via the pivoting linkage and the auxiliary cleaning device support 70. A bias adjustment knob 120 is attached to the upper end of the rod and is supported by the support member 112. For adjustment of the spring and thus, adjustment of the biasing force for the cleaning bar, the knob is moved or pulled in a vertical direction, as indicated by arrow 122 and as shown in detail FIG. 3, and then the knob is rotated as indicated by arrow 124.

As shown in the detail FIG. 3, a protrusion 126 is provided on the knob 120 which selectively moves into one of a plurality of apertures such as apertures 128, in the support member 112 which are located in a spaced apart and generally circular pattern. Thus, after it is rotated to attain a desired biasing force, the knob is moved downwardly so that the protrusion moves within one of the apertures to assure retention of the knob at the desired selected bias setting. Although the adjustable spring biasing arrangement is illustrated, it is readily apparent that other biasing arrangements could be provided such as, for example, simply fabricating the auxiliary cleaning device support (FIG. 6) so as to have a desired weight or by adding additional weights thereto to provide a desired biasing force.

Referring to FIG. 2, the cleaning bar 68 is formed of a porous material having a cleaning liquid supplied thereto for subsequent transferral to a carpeted surface via frictional engagement therewith. The bar may be formed of numerous materials or material combinations such as, for example, felt, open cell foam, or other fiber materials. It is desirable that the bar be porous, have capillary characteristics and be absorbent so as to saturate without dripping. It is also desirable that the bar be formed or coated with a material which would tend to minimize surface tension with a carpet as it is moved thereacross. A bar which was found to be particularly desirable was formed of extruded synthetic material, i.e., nylon, which was compressed and bound, utilizing a cellular binding material, into the illustrated substantially rectangular configuration. This preferred fiber bar was manufactured by American Filtrona Filter Company under Model Number D449B. This particular bar had a density of 0.235 grams per cubic centimeter with the nylon fibers having a diameter of approximately 0.028 millimeters.

A liquid supply means is provided for supplying a cleaning material solution to the cleaning bar 68. In the arrangement illustrated, the liquid supply means includes a liquid holding container 130, a flexible tube 132 and a spring loaded, normally closed dispensing valve 134 which is opened via an acutator arrangement which includes dispensing trigger 136, control rod 138 and pivoting beam 140 (also see FIG. 4). The liquid holding container is accommodated within recess 142 of the handle assembly 24 and is held therein by raised ledge 144 and pin 146 of removable container lid 148 with the pin being received within a hole 150 extending vertically from the recessed portion. The container is removed for refilling by pulling outwardly on the lid and then lifting the container from the recessed portion. The lid is then removed for refilling via opening 152 located at the top of the container. It is preferable that the cleaning liquid be a low foaming type and a type which leaves a minimum of residue on a carpet. Carpet cleaning liquids utilized with hot water extractors such as, for example, Hoover emulsifier carpet cleaner model C7001-002, have been employed successfully. To open the dispensing valve for supplying liquid via the flexible tube to the cleaning bar, the dispensing trigger is pivoted about mounting pin 153 toward handle grip 154 which, as illustrated in FIG. 4, moves the control rod 138 downwardly to pivot the beam about pivot pin 156 so as to cause beam plate 158 to lift valve rod 160 and open the dispensing valve. Referring again to FIG. 2, a beam spring 162 (FIG. 4) and valve spring 163 return the beam and dispensing valve to their illustrated positions when the dispensing trigger is released whereby the dispensing valve is closed. An initial saturation lever 164 is pivotally connected to the control rod by a pin 165 which provides the interconnection between the control rod and the dispensing trigger. In operation, movement of the dispensing trigger causes dispensing valve movement and flow within a predetermined range with full trigger movement providing a valve position which is less than full open or full flow. However, to achieve quick initial bar saturation, the initial saturation lever is pivoted about the pin 165 to a full down position which causes the control rod to move downwardly a greater distance than is achievable via full trigger movement thereby causing the dispensing valve to move to a full open or full flow position. As illustrated, the dispensing valve, the valve spring and a tionship, the first support portion is allowed to pivot or rotate in a rocking motion relative to the second support portion so as to compensate for uneven carpet elevations which may be caused by, for example, uneven floors or high traffic causing depression or matting of a strip or segment of a carpet. Thus, when the cleaning bar encounters uneven carpet elevations, the higher elevated carpet portion will cause the bar to pivot about the pivot post so that the transverse elevation of the bar is changed to provide more even or uniform contacting relationship between the bar and the carpeted floor across the full extent or length of the bar.

As mentioned previously, the link arm 74 has the cleaning bar 68 pivotally connected to one end thereof via the bar support 72. At the opposite end, the link arm is provided with a drilled support sleeve 238 which receives and pivots about the rear axle 56. Thus, as can be seen clearly in FIG. 2, the lonk arm 74 when positioned on the apparatus 20, extends from the rear axle 56 forwardly toward the agitator 36 whereby the end thereof having the cleaning bar 68 pivotally connected thereto leads the opposite or axle connected end as the apparatus is moved or pushed in a forward longitudinal direction across a carpeted surface.

Figure 8:
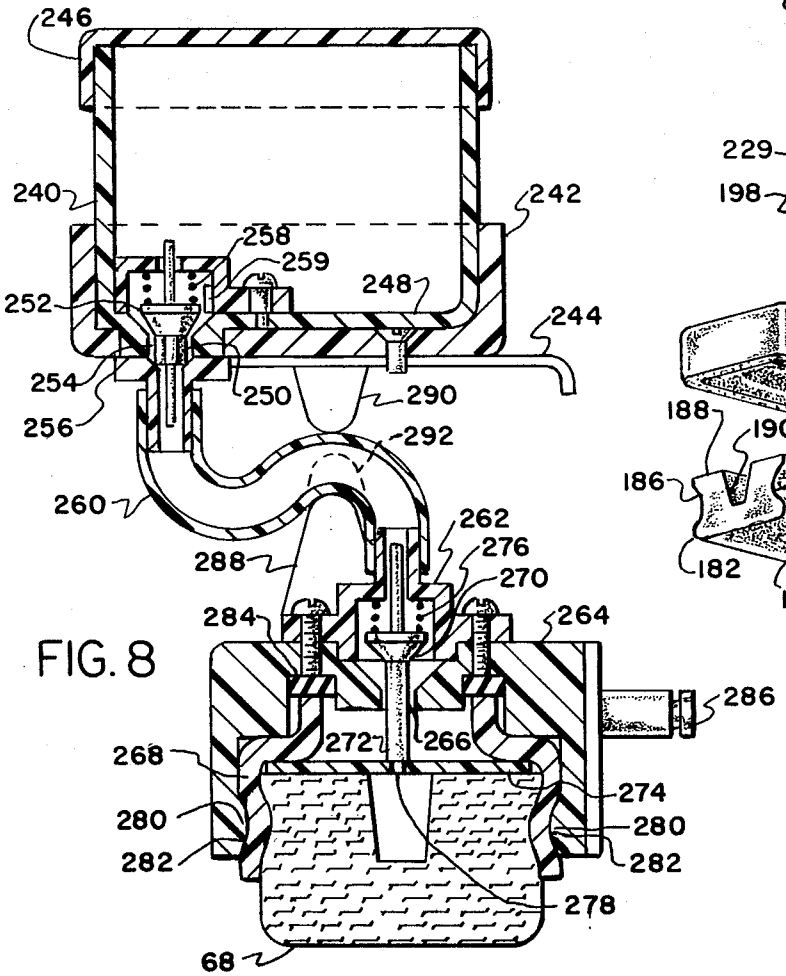
FIG. 8 is a side elevated cross sectional view of an alternate arrangement for supplying and controlling liquid flow to an auxiliary cleaning device of the type illustrated in FIGS. 1, 2, and 5–7.

FIG. 8 illustrates an alternate or modified arrangement wherein a cleaning liquid reservoir 240 is positioned in close proximity the cleaning bar 68 and is removably positioned within a channel member 242 attached to support plate 244 which could be integral with a nozzle such as, for example, nozzle 22 shown in FIG. 2. A removable cap 246 is provided to allow filling of the reservoir with cleaning liquid. The base 248 of the reservoir has an output flow opening 250 therein which is automatically closed or blocked via a spring loaded check valve 252 when the reservoir is removed from the channel member with the check valve being mounted integral with the reservoir and removable therewith. When the liquid reservoir is in its illustrated mounted position, spaced apart downward extending projections or splines 254, of the valve engage fitting 256 causing the valve to be lifted so as to compress spring 258 for opening the valve thereby permitting liquid flow from the reservoir to the fitting via openings such as, for example, opening 259, and the valve. A flexible hose 260 connects to the reservoir via the fitting 256 and extends to fitting 262 attached to bar support 264. An opening 266 is provided in the bar support to transmit liquid from the fitting into bar holder 268 with a second spring loaded check valve 270 being provided to close the opening or port when the cleaning bar and its holder are removed from bar support. When the bar and its holder are mounted within the bar support, valve stem 272 engages plate 274 of the bar holder to cause compression of spring 276 for opening the valve. The plate is provided with a plurality of holes, such as, for example, hole 278, which are spaced apart in such a manner as to provide substantially even liquid flow to the cleaning bar. The bar and bar holder are removably held within the bar support by a detent arrangement comprising outwardly extending projection portions 280 of the bar support which are received within respective recesses 282 of the holder. The bar support and/or the bar holder may be formed of plastic or other suitable resilient material which can be flexed so as to permit easy mounting and positive retention via the detent arrangement while also allowing easy removal of the bar and bar holder. Packing 284 provides a seal between the bar holder and bar support. The bar support is provided with a pivot post 286 which can be connected to the second mounting support portion 74 (FIG. 7) in the same manner as pivot post 234 (FIG. 7) and utilized in conjunction with other elements of apparatus 20 (FIG. 2), except for the liquid dispensing elements, to provide substantially the same mounting and operation of the cleaning bar as illustrated and described in reference to FIGS. 1–2 and 5–7.

A liquid shut-off means is also provided for automatically terminating the flow of liquid to the cleaning bar 68 when the bar is moved upwardly to a retracted position. The shut-off means includes oppositely disposed pinching elements 288 and 290 attached to the bar support 264 and channel support 244, respectively. The flexible hose 260 is pinched between the two elements by upward movement of the pinching element 288 to the illustrated dotted position 292 when the bar is retracted thereby terminating liquid flow therethrough. As mentioned previously, the bar and bar support can be mounted or incorporated in a cleaning apparatus in the same manner as the bar and the first support portion 72 of the apparatus described in reference to FIGS. 2 and 5–7. Thus, the bar will be retracted automatically in response to movement of an apparatus handle assembly from an inclined operating position to an upright or storage position with the shut-off or pinching elements being responsive to such handle assembly movement via bar movement to automatically terminate liquid flow when the handle assembly moves to the storage position.

FIGS. 9 and 10 illustrate details of the rotatable agitator 36. As can be seen in FIG. 9, the agitator includes an end cap 294 and a plurality of brushes or brush bristle tufts 296 which are arranged in two adjacent rows 298 and 300 and which are disposed about a substantially cylindrical agitator body 302 in a helical configuration. As can be seen in FIG. 10, the brush rows 298 and 300 are disposed on opposite sloped sides 304 and 306, respectively, of a molded plastic mounting strip 308 having respective grooves 310 and 311. The agitator body 302 is formed with a helical slot bounded by edge portions 312 and 313 which are received within the grooves 310 and 311, respectively, for retaining the molded strip. The brush bristle tufts of the adjacent rows form a V-shaped configuration with the bristles thereof disposed at acute angles relative to an imaginary vertical line 314 passing therebetween for providing wiping contact with carpet fibers 316 during agitator rotation as indicated by arrow 317. Such wiping contact provides brush contact over a greater surface of the carpet fibers than attainable with vertically oriented brushes which facilitates distribution of cleaning material on the fibers and thereby improves removal of adhering dirt, dust and other particles therefrom.

FIG. 11 shows an alternate cleaning bar 318 which may be utilized with the previously illustrated and described apparatus 20. The illustrated cleaning bar is formed of a dry material which erodes during frictional engagement with a carpet. Although it is believed that the bar can be formed from several different materials or material compositions to provide a cleaning effect on a carpet, it is especially desirable that the bar erode uniformly so as to provide uniform dispersion of particles for cleaning and that the bar erode at relatively low rate so as to permit cleaning of a reasonable area of a carpeted surface before a new bar is needed. It is also desirable that the bar have a relatively low friction surface for carpet engagement so as to minimize any increase in manipulative effort due to bar engagement with a carpet. Further, it is desirable that the eroded particles be small in average size. The assignee of the present invention has found that a bar formed of a chalk material such as, for example, a blackboard break-in chalk number 31-226 manufactured by American Crayon Company or a textile mill chalk number N1081, color number 581, white made by The Joseph Dixon Crucible Company, to be desirable and effective for carpet cleaning. Such bars may vary in hardness, but it has been found more desirable to employ the ones of such bars having a Shore A Durometer hardness reading of approximately 70 or below in order to provide desirable erosion characteristics although bars with a greater hardness may provide some cleaning. It has also been found that such bars often have an outer surface which is harder than its interior and thus, a particular bar may provide more desirable erosion characteristics after the outer surface is removed. The cleaning bar may be secured in bar holder 320 in any desired manner such as, for example, by gluing with, for example, Dow Corning Silicon Rubber Sealant Number 1514300-1276. The bar can be utilized with the previously described apparatus 20 in FIG. 2. However, the apparatus may be simplified by deleting the liquid supply means including the dispenser control lever 136, the liquid supply container 130, the flexible hose 132 and other elements associated with the supplying of liquid. The dry bar holder is also provided with an integral projection 322 and a recess ledge 324 for attachment to the first mounting support portion or bar support 72 in the same manner as the wet cleaning bar 68 as previously illustrated and described in reference to FIG. 7. When operated in conjunction with such a modified apparatus, the dry cleaning bar is moved into a carpet engaging position and the apparatus is moved across a carpeted surface. The bottom surface 326 of the bar erodes via frictional engagement with a carpet so as to distribute dry cleaning particles on a carpet. The frictional engagement and simultaneous releasing of particles function to release dust, dirt, etc. particles adhering to carpet fibers so that they can be removed via agitation and vacuum in a manner previously described.

While there have been shown and described herein preferred embodiments of the present invention, it should be apparent to persons skilled in the art that numerous modifications may be made therein without departing from the true spirit and scope of the invention. Accordingly, it is intended by the appended claims to cover all such modifications which come within the spirit and scope of this invention.

I claim:

1. In a carpet cleaning apparatus having a nozzle including a nozzle chamber communicating with a carpet surface, vacuum generating means for drawing dirt laden air through the nozzle chamber, an agitator including brushes, a handle assembly pivotally connected to the nozzle and movable between an operating position where it is generally inclined relative to a carpeted surface and a storage position where it is generally vertical relative to a carpeted surface, and an auxiliary cleaning device engageable with a carpet surface to provide additional cleaning, the improvement comprising:

retraction means responsive to pivotal movement of said handle assembly to the storage position for automatically moving said auxiliary cleaning device to a retracted position out of engagement with a carpet surface;

retaining means for locking said auxiliary cleaning device in the retracted position, said retaining means selectively permitting either movement of said auxiliary cleaning device to a carpet engaging position or maintaining said auxiliary device in the retracted position independently of subsequent handle assembly movement from the storage position.

2. The carpet cleaning apparatus of claim 1 wherein said retraction means also maintains said auxiliary cleaning device in a retracted position while said handle assembly is in the storage position.

3. The carpet cleaning apparatus of claim 1 further including auxiliary release means for actuating said retaining means to permit downward movement of said auxiliary cleaning device.

4. The carpet cleaning apparatus of claim 1 further including an auxiliary cleaning device mounting support and wherein said retraction means is carried in part by said auxiliary cleaning device mounting support and in part by said handle assembly.

5. The carpet cleaning apparatus of claim 4 wherein said retaining means engages the part of said retraction means carried by said auxiliary cleaning device mounting support when said handle assembly is pivoted to the storage position for locking said auxiliary cleaning device in the retracted position.

6. The carpet cleaning apparatus of claim 1 further including auxiliary release means integrally connected to said retaining means and pivotally supported so that movement of said auxiliary release means in a predetermined direction causes simultaneous movement of said retaining means to a disengagement position.

7. The carpet cleaning apparatus of claim 1 further including biasing means for exerting a downwardly directed force on said auxiliary cleaning drvice when it is in a carpet engaging position.

8. The carpet cleaning apparatus of claim 1 wherein said auxiliary cleaning device comprises a bar having a generally rectangular shape and further including guide means for guiding movement of the bar into and out of engagement with a carpet surface, said guide means comprising a link arm having one end pivotally secured to the carpet cleaning apparatus and an opposite end thereof pivotally connected to said bar.

9. The carpet cleaning apparatus of claim 8 wherein said link arm is positioned on the apparatus so that the opposite end thereof having said bar pivotally connected thereto leads the one end thereof when the apparatus is moved in a forward longitudinal direstion.

10. The carpet cleaning apparatus of claim 1 wherein said auxiliary cleaning device includes a bar of dry material which erodes to disperse particles during frictional engagement with a carpet.

11. The carpet cleaning apparatus of claim 1 further including liquid supply means for supplying a cleaning liquid to said auxiliary cleaning device and wherein said auxiliary cleaning device is formed of a porous material for transferring cleaning liquid to a carpet surface.

12. The carpet cleaning apparatus of claim 11 wherein said auxiliary cleaning device comprises a bar of compressed, synthetic fibers.

13. The carpet cleaning apparatus of claim 1 wherein said agitator includes a substantially cylindrical body and two adjacent rows of brushes disposed in a helical configuration about the body and wherein the brushes of the two adjacent rows are disposed at an acute angle relative to an imaginary vertical line extending therebetween so that brushes of the two rows establish a V-shape configuration thereby providing wiping engagement of the brushes with fibers of a carpet.

14. In a carpet cleaning apparatus having a nozzle including a nozzle chamber communicating with a carpet surface, vacuum generating means for drawing dirt laden air through the nozzle chamber, an agitator including brushes, a handle assembly pivotally connected to the nozzle and movable between an inclined position relative to a carpet surface and a storage position where it is generally vertical relative to a carpet surface, an auxiliary cleaning device engageable with a carpet surface to provide additional cleaning and liquid supply means for supplying liquid to said auxiliary cleaning device, the improvement comprising:

liquid shut-off means responsive to pivotal movement of said handle assembly to the storage position for terminating liquid flow to said auxiliary cleaning device; and retraction means responsive to movement of said handle assembly to the storage position for automatically moving said auxiliary cleaning device to a retracted position out of engagement with a carpet surface.

15. The carpet cleaning apparatus of claim 14 wherein said liquid shut-off means is operated by movement of said auxiliary device to the retracted position for terminating liquid flow thereby being responsive to handle assembly movement to the storage position.

16. The carpet cleaning apparatus of claim 14 further including means for automatically interrupting liquid flow from said liquid supply means to said auxiliary cleaning device when said auxiliary cleaning device is removed from the carpet cleaning apparatus.

17. The carpet cleaning apparatus of claim 14 wherein said liquid supply means includes a liquid holding container removably mounted on the apparatus and further including a valve actuated to an open position when said liquid holding container is mounted on the apparatus and operable to automatically shut-off liquid flow from said liquid holding container when the container is removed from the apparatus.

18. The carpet cleaning apparatus of claim 14 further including means for varying liquid flow within a predetermined range to said auxiliary cleaning device and initial saturation means for providing a liquid flow greater than an amount within the predetermined range for accelerating initial saturation of said auxiliary cleaning device.

19. A carpet cleaning apparatus having a nozzle including a nozzle chamber communicating with a carpet surface, vacuum generating means for drawing dirt laden air through the nozzle chamber, an agitator including brushes, a handle assembly pivotally connected to the nozzle and movable between an operating position where it is generally inclined relative to a carpeted surface and a storage position where it is generally vertical relative to a carpeted surface, and an auxiliary cleaning device elongated in a direction transverse to direction of travel of the carpet cleaning apparatus and engageable with a carpet surface to provide additional cleaning, said carpet cleaning apparatus further comprising:

compensating means providing support for said auxiliary cleaning device at a generally central location along the transverse extent thereof and providing for change in transverse elevation of said auxiliary cleaning device in response to an uneven carpet surface thereby establishing a more uniform contact interrelationship between said auxiliary cleaning device and a carpet surface.

20. The carpet cleaning apparatus of claim 19 wherein said compensating means includes a single pivot member providing central pivotal movement of said auxiliary cleaning device so as to change its elevation across the transverse extent thereof in response to an uneven carpet surface.

21. A carpet cleaning apparatus comprising a nozzle including a nozzle chamber communicating with a carpet surface, vacuum generating means for drawing dirt laden air through the nozzle chamber, an agitator including brushes, a handle assembly pivotally connected to the nozzle and movable between an operating position where it is generally inclined relative to a carpet surface and a storage position where it is generally vertical relative to a carpet surface and an auxiliary cleaning device engageable with a carpet surface to provide additional cleaning, said carpet cleaning apparatus further comprising:

retraction means responsive to pivotal movement of said handle assembly to the storage position for automatically moving said auxiliary cleaning device relative to said agitator to a retracted position out of engagement with a carpet surface; and compensating means for providing a change in transverse elevation of said auxiliary cleaning device in response to an uneven carpet surface thereby providing a more uniform contact interrelationship between said auxiliary cleaning device and a carpet surface.

22. The carpet cleaning apparatus of claim 21 wherein said compensating means includes a single pivot member providing central pivotal movement of sad auxiliary cleaning device so as to change its elevation across the transverse extent thereof in response to an uneven carpet surface.

23. The carpet cleaning apparatus of claim 21 further including retaining means for locking said auxiliary cleaning device in the retracted position when the handle assembly is moved to a storage position.

24. The carpet cleaning apparatus of claim 23 wherein said retaining means selectively permits either movement of said auxiliary cleaning device to a carpet engaging position or maintains said auxiliary device in the retracted position independently of subsequent handle movement from the storage position.

* * * * *